US007350497B2

(12) United States Patent
Hiraoka et al.

(10) Patent No.: US 7,350,497 B2
(45) Date of Patent: Apr. 1, 2008

(54) OUTBOARD MOTOR LUBRICATION SYSTEM

(75) Inventors: Noriyoshi Hiraoka, Shizuoka-ken (JP); Hiroaki Takase, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/283,557

(22) Filed: Nov. 18, 2005

(65) Prior Publication Data

US 2006/0102134 A1 May 18, 2006

(30) Foreign Application Priority Data

Nov. 18, 2004 (JP) ..... 2004-335148

(51) Int. Cl.
*F02B 75/00* (2006.01)

(52) U.S. Cl. ..... 123/196 R; 123/196 W

(58) Field of Classification Search ..... 123/195 C, 123/196 W, 196 R, 196 AB; 440/88 L, 88 R
See application file for complete search history.

(56) References Cited

U.S. PATENT DOCUMENTS 4,311,009 A * 1/1982 Elsbett et al. ..... 60/605.1
4,616,609 A * 10/1986 Munch et al. ..... 123/196 AB
6,189,501 B1 * 2/2001 Fujii et al. ..... 123/195 C
6,257,178 B1 * 7/2001 Laimbock ..... 123/54.1
6,435,272 B1 * 8/2002 Voss ..... 165/182
2003/0140888 A1 * 7/2003 Tanaka et al. ..... 123/196 R
2004/0177827 A1 * 9/2004 Hoyte et al. ..... 123/196 AB

FOREIGN PATENT DOCUMENTS

JP HEI 05-278687 10/1993

* cited by examiner

*Primary Examiner*—Stephen K. Cronin
*Assistant Examiner*—Hyder Ali
(74) *Attorney, Agent, or Firm*—Knobbe Martens Olson & Bear LLP

(57) ABSTRACT

A lubrication system of an outboard motor delivers lubricant to an internal combustion engine. The internal combustion engine is supported by an upper end of a case. The lubrication system has an oil pan configured to hold lubricant oil. An oil conduit has a lower end opening to the oil pan. An upper end of the oil conduit extends towards the internal combustion engine. An oil pump delivers the lubricant oil towards the internal combustion engine through the oil conduit. The oil pump is located in the vicinity of a front part of the oil pan as viewed from the side of the outboard motor. An inside bottom surface of the oil pan defines a lower bottom portion and an upper bottom portion. The lower bottom portion is located under the lower end of the oil conduit. The upper bottom portion of the oil pan is positioned rearward of the lower bottom portion.

23 Claims, 4 Drawing Sheets

OUTBOARD MOTOR LUBRICATION SYSTEM

PRIORITY INFORMATION

The present application is based on and claims priority under 35 U.S.C. § 119(a-d) to Japanese Patent Application No. 2004-335148, filed on Nov. 18, 2004, the entire contents of which is expressly incorporated by reference herein.

BACKGROUND OF THE INVENTION

1. Field of the Invention

The present invention generally relates to lubrication systems for motors and more particularly relates to lubrication systems used with outboard motors.

2. Description of the Related Art

Outboard motors often have a lubrication system for providing a lubricant to an internal combustion engine. Japanese Patent Publication No. Hei 5-278687 discloses an outboard motor equipped with a lubrication system. The outboard motor includes a vertically extending case pivotally supported on a hull of a boat. The lower portion of the outboard motor can be submerged in water in which the boat floats. A rotatable propeller is supported by a lower end portion of the case. The outboard motor has an internal combustion engine supported within the upper end portion of the case. The engine drives the propeller to propel the boat.

The outboard motor has an oil pan for holding lubricant oil that is used by the internal combustion engine. An oil pipe has a lower end opening into the deepest portion of the inside bottom of the oil pan and an upper end extending towards the internal combustion engine. An oil pump operates to draw oil from the oil pan through the oil pipe towards the internal combustion engine.

When the internal combustion engine operates, the propeller is driven by the engine to propel the boat. The engine also drives an oil pump so that lubricant oil in the oil pan is fed through the oil pipe to lubricate various components of the engine.

In the lubrication system, an inside surface of the oil pan is sloped down towards the rear of the outboard motor. To discharge the lubricant oil in the oil pan (e.g., to change the lubricant oil), the lower part of the outboard motor is swung up. Once the outboard motor is rotated upwardly, the inside front surface of the oil pan is sloped downwardly towards the boat so that the lubricant oil in the oil pan is discharged to an oil receiver.

Unfortunately, the lubrication system has a complicated design. Additionally, the inside front surface of the oil pan is sloped down rearwardly when the outboard motor is positioned within the water. As such, the oil pipe and the oil pump are spaced widely apart from each other in the longitudinal direction of the boat. As such, the oil passage between the oil pipe and the oil pump may be overly complicated.

SUMMARY OF THE INVENTION

One aspect of the present invention involves an outboard motor comprising a vertically extending case configured to be supported on a hull of a watercraft. An upper end of the case supports an internal combustion engine. An oil pan is adapted to hold lubricant for lubricating the internal combustion engine. An oil conduit extends upwardly towards the internal combustion engine and has a lower end that defines an opening. An oil pump is adapted to draw lubricant through the lower end of the oil conduit and direct a lubricant flow through the oil conduit and to the internal combustion engine. The oil pump is positioned in the vicinity of a front portion of the oil pan when the outboard motor is attached to the hull. The oil pan has a bottom that comprises a first bottom surface and a second bottom surface. A lower portion of the oil pan is located below the lower end of the oil conduit and comprises the first bottom surface. The lower portion is positioned forwardly of the second bottom surface. The second bottom surface is generally vertically higher than the first bottom surface.

Another aspect of the present invention involves an outboard motor that comprises an internal combustion engine and a lubrication system. The lubrication system comprises a lubricant pan for holding lubricant that lubricates the internal combustion engine. The lubricant pan has a bottom defining a lower bottom portion and an upper bottom portion that is positioned higher than the lower bottom portion such that lubricant collects in the lower bottom portion when the outboard motor is in a substantially vertical orientation. At least a portion of the lower bottom portion is positioned forward of the upper bottom portion. A lubricant conduit has a lower end and an upper end. The lower end defines a lower opening and is positioned above the lower bottom portion of the lubricant pan. A lubricant pump draws lubricant supported by the lower bottom portion of the lubricant pan into the lower end of the lubricant conduit such that lubricant flows through the lubricant conduit towards the internal combustion engine.

BRIEF DESCRIPTION OF THE DRAWINGS

The above-mentioned and other features of the invention disclosed herein are described below with reference to the drawings of a preferred embodiment. The illustrated embodiment is intended to illustrate, but not to limit the invention. The drawings comprise four figures.

DETAILED DESCRIPTION OF THE PREFERRED EMBODIMENT

Figure 1:
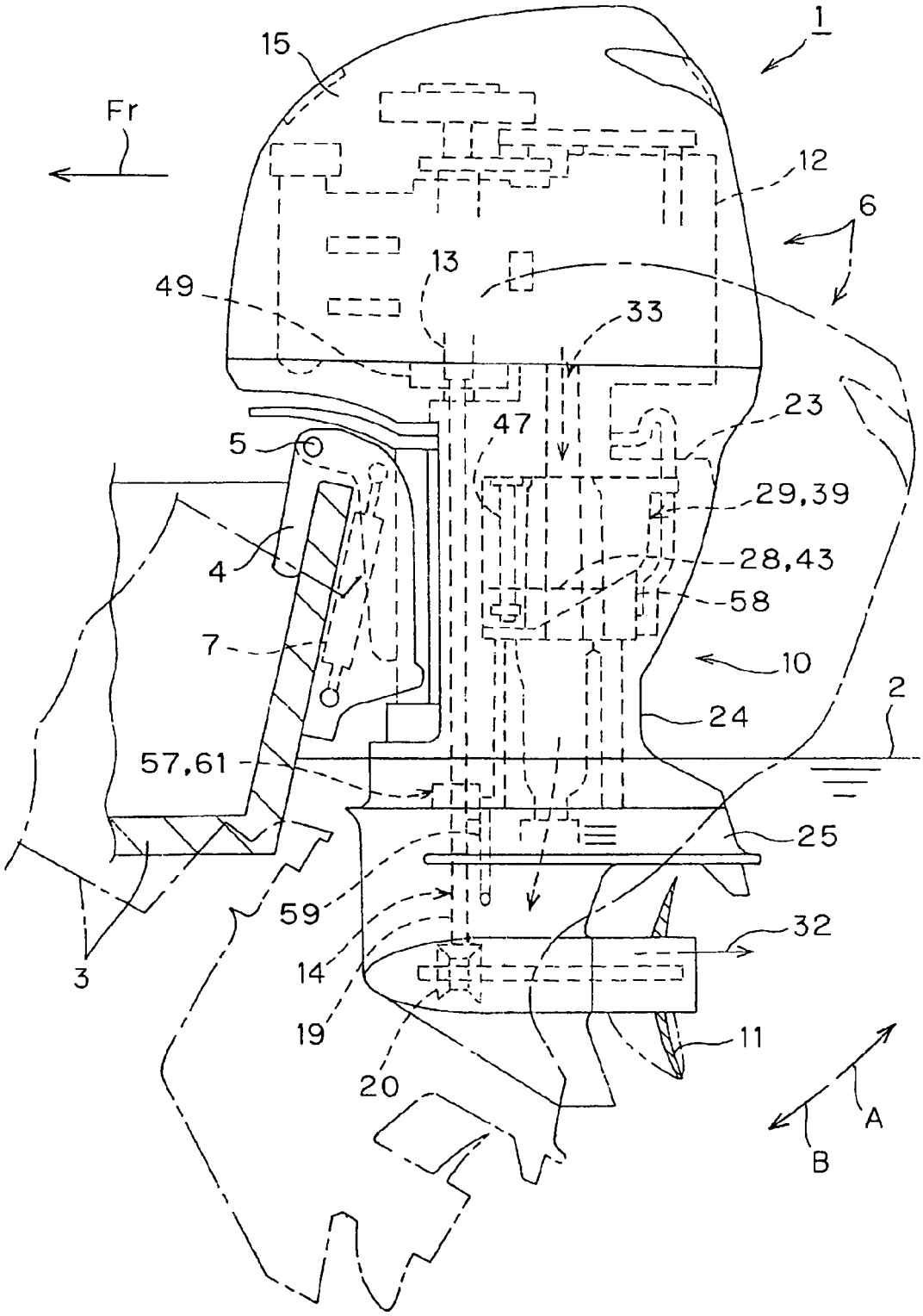
FIG. 1 is a side elevational view of an outboard motor attached to a hull of a watercraft. The internal components of the motor are shown in phantom.

With reference to FIG. 1, watercraft 1 has an outboard motor 6 that is configured in accordance with certain features, aspects, and advantages of the present invention. The outboard motor 6 is a typical marine drive, and thus all the embodiments below are described in the context of an outboard motor. The embodiments, however, can be applied to other marine drives, such as, for example, inboard drive and outboard drives (or stern drives), as will become apparent to those of ordinary skill in the art. The arrow FR in FIG. 1 indicates the forward direction in which the watercraft 1 travels.

The watercraft 1 includes a hull 3 that is floating on the water surface 2. A clamp bracket 4 is attached to the rear end of the hull 3. The outboard motor 6 is supported at the rear end of the hull 3 by a pivotal member 5 supported by the clamp bracket 4. An actuator device 7 can selectively actuate the outboard motor 6 upwardly and downwardly. The illustrated actuator 7 is a hydraulic actuator that can tilt up (as indicated by the arrow A) and tilt down (as indicated by the arrow B) the lower portion of the outboard motor 6 about the pivotal member 5. Other mounting arrangements can be used to mount the motor 6 to a hull of a watercraft.

Figure 2:
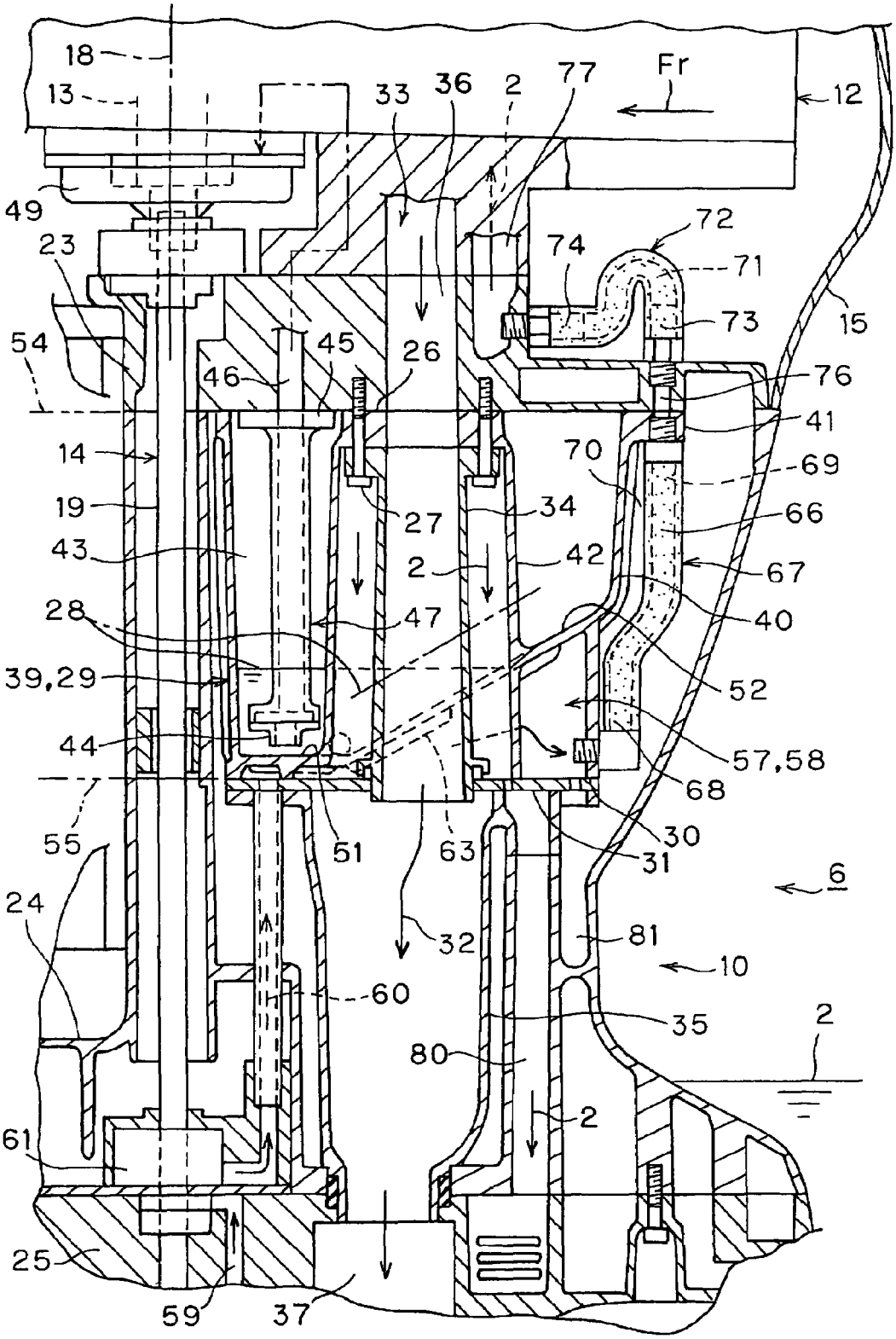
FIG. 2 is a partially enlarged, sectional view of the outboard motor shown in FIG. 1. A portion of an oil pan and other components are shown in phantom.

With reference to FIGS. 1 and 2, the illustrated outboard motor 6 includes a case 10 that forms an outer shell of the outboard motor 6. The case 10 can be made of aluminum or other suitable material for forming a protective casing. A propulsion unit 101 has a propeller 11 rotatably supported by the lower end of the case 10. An internal combustion engine 12 can be supported by the upper end of the case 10. A power transmission 14 interlocks a crankshaft 13 of the internal combustion engine 12 with the propulsion unit 101. Rotation of the crankshaft 13 causes rotation of the propeller 11. A cowling 15 can cover the internal combustion engine 12.

The internal combustion engine 12 is preferably a multi-cylinder, four-cycle engine. Engines having a different number of cylinders, other cylinder arrangements, various cylinder orientations (e.g., upright cylinder banks, and V-type), and operating on various combustion principles (e.g., four stroke, crankcase compression two-stroke, diesel, and rotary) are all practicable for use with the lubrication system disclosed herein. The engine 12 comprises an engine body defining at least one cylinder bore therethrough. A cylinder head assembly is connected to the cylinder bore, and a piston is disposed within the cylinder bore. The cylinder bore, the cylinder head assembly, and the piston cooperate to define a variable combustion chamber.

With continued reference to FIGS. 1 and 2, the case 10 extends vertically and is pivotally supported by the pivotal member 5 of the clamp bracket 4. The power transmission 14 is housed in the case 10. The lower part of the case 10 and the propeller 11 are submerged in the water 2 when the outboard motor 6 is in the illustrated lowered position. When the outboard motor 6 is in the illustrated vertical orientation, the propeller 11 is complete submerged in the water 2.

With reference to FIG. 2, the axis 18 of the crankshaft 13 is generally vertically oriented. The power transmission 14 preferably includes a power transmission shaft 19 extending along the axis 18 of the crankshaft 13. A gear system 20 interlocks the propulsion unit 101 with the lower end of the power transmission shaft 19. The upper end of the power transmission shaft 19 is preferably interlocked with the crankshaft 13. As such, the crankshaft 13 is drivingly connected to the propulsion unit 101. When the engine 12 operates, the crankshaft 13 and transmission shaft 15 can rotate about the axis 18. The rotating shaft 19 drives the propulsion unit 101. Accordingly, the crankshaft 13 drives the propeller 11.

The illustrated propeller 11 of the propulsion unit 101 is a single propeller system; however, other types of propulsion units can be used as well, such as, for example, a dual counter-rotational propeller system, a jet drive, and the like. The outboard motor 6 is supported on the transom of the hull 3 by the clamp bracket 4 so as to place at least a portion of the propulsion unit 101 in a submerged position when the watercraft 1 rests in the water 2. The motor 6 is preferably steerable and/or tiltable by moving the clamp 4.

With continued reference to FIGS. 1 and 2, the case 10 preferably includes an exhaust guide 23 having an upper surface that supports the internal combustion engine 12. An upper case 24 is preferably attached to the underside of the exhaust guide 23. A lower case 25 can be attached to the underside of the upper case 24. As such, at least a portion of the upper case 24 is interposed between the exhaust guide 23 and the lower case 25. The exhaust guide 23 preferably defines the upper end portion of the case 10 positioned below the cowling 15. The upper case 24 defines a middle portion of the case 10. The lower case 25 defines the lower portion of the case 10.

The case 10 also defines an oil pan 29 for holding lubricant 28, such as oil, that lubricates the internal combustion engine 12. A partition plate 31 is joined to the lower surfaces of the oil pan 29. The illustrated partition plate 31 mates with the lower surfaces of the oil pan 29. The partition plate 31 separates the oil pan 29 and the muffler 35.

The oil pan 29 can be positioned within the upper portion of the upper case 24 between the partition plate 31 and the exhaust guide 23. In some embodiments, including the illustrated embodiment, the upper case 24 and the oil pan 29 are made as separate parts. The upper end surface 26 of the oil pan 29 mates with and is attached to the underside surface of the exhaust guide 23 by one or more couplers 27. Bolts, fasteners, mechanical assemblies (e.g., nut and bolt assemblies), or other coupling means can be used to couple the oil pan 29 to the exhaust guide 23. The illustrated threaded fasteners couple the oil pan 29 to the exhaust guide 23. The inside bottom surface of the oil pan 29 holds the lubricant 28.

With continued reference to FIGS. 1 and 2, an exhaust system 33 is provided for discharging exhaust gases outputted from the engine 12. The illustrated exhaust system 33 delivers exhaust gases 32 discharged from the internal combustion engine 12 into the water 2.

An upstream side exhaust passage 36 connects the exhaust passage of the internal combustion engine 12 to an upper end portion of the exhaust conduit 34. The exhaust passage extends through both the exhaust guide 23 and the oil pan 29.

The exhaust system 33 preferably includes an exhaust conduit 34 extending downwardly from the engine 12. In some embodiments, including the illustrated embodiment, the exhaust conduit 34 extends vertically inside of the upper portion of the upper case 24. One or more fasteners 27 couple an upper end portion of the exhaust conduit 34 to the exhaust guide 23. The illustrated fasteners 27 couple both the exhaust conduit 34 and the oil pan 29 to the exhaust guide 23. In some embodiment, an upper flange of the exhaust conduit 34 has a plurality of through holes for receiving the fasteners 27. The lower end portion of the exhaust conduit 34 can extend downwardly, preferably extending through the partition plate 31.

In some embodiments, a muffler 35 can be provided to reduce noises emitted from the outboard motor 6. The illustrated muffler 35 extends vertically inside of the lower portion of the upper case 24. The upper end portion of the muffler 35 can be attached to the underside of the partition plate 31 so as to be in fluid communication with the exhaust conduit 34. The lower end of the muffler 35 can be connected to the lower case 25. As such, exhaust gases 32 can flow through the exhaust conduit 34 and the muffler 53. A downstream side exhaust passage 37 connects the lower end portion of the muffler 35 to the water 2. The downstream side exhaust passage 37 can be formed in the lower case 25.

A lubrication system 129 includes an oil pan 29 that holds lubricant 28. The lubricant 28 can be any lubricant known in the art, including but not limited to, natural lubricants, artificial lubricants, oils, or any other lubricants known in the art. In some embodiments, the lubricant includes one or more additives. The lubricant 28 can be used to lubricate various parts of the internal combustion engine 12. In some embodiments, the oil pan 29 includes an oil pan body 40 (FIG. 2) that is somewhat bowl shaped, although the pan body 40 can also have other shapes. The pan body 40 can surround the exhaust conduit 34. The oil pan body 40 preferably has an outer mounting structure 41. The illustrated mounting structure is in the form of an outwardly extending flange 41 that is formed integrally with the upper end portion of the oil pan body 40. An inner wall 42 can be formed by the central portion of the oil pan body 40. The inner wall 42 preferably surrounds and is spaced from the exhaust conduit 34. The illustrated inner wall 42 is somewhat cylindrical in shape. For a compact configuration, the inner wall 42 is a vertically extending wall that is generally coaxial with the exhaust conduit 34.

Figure 4:
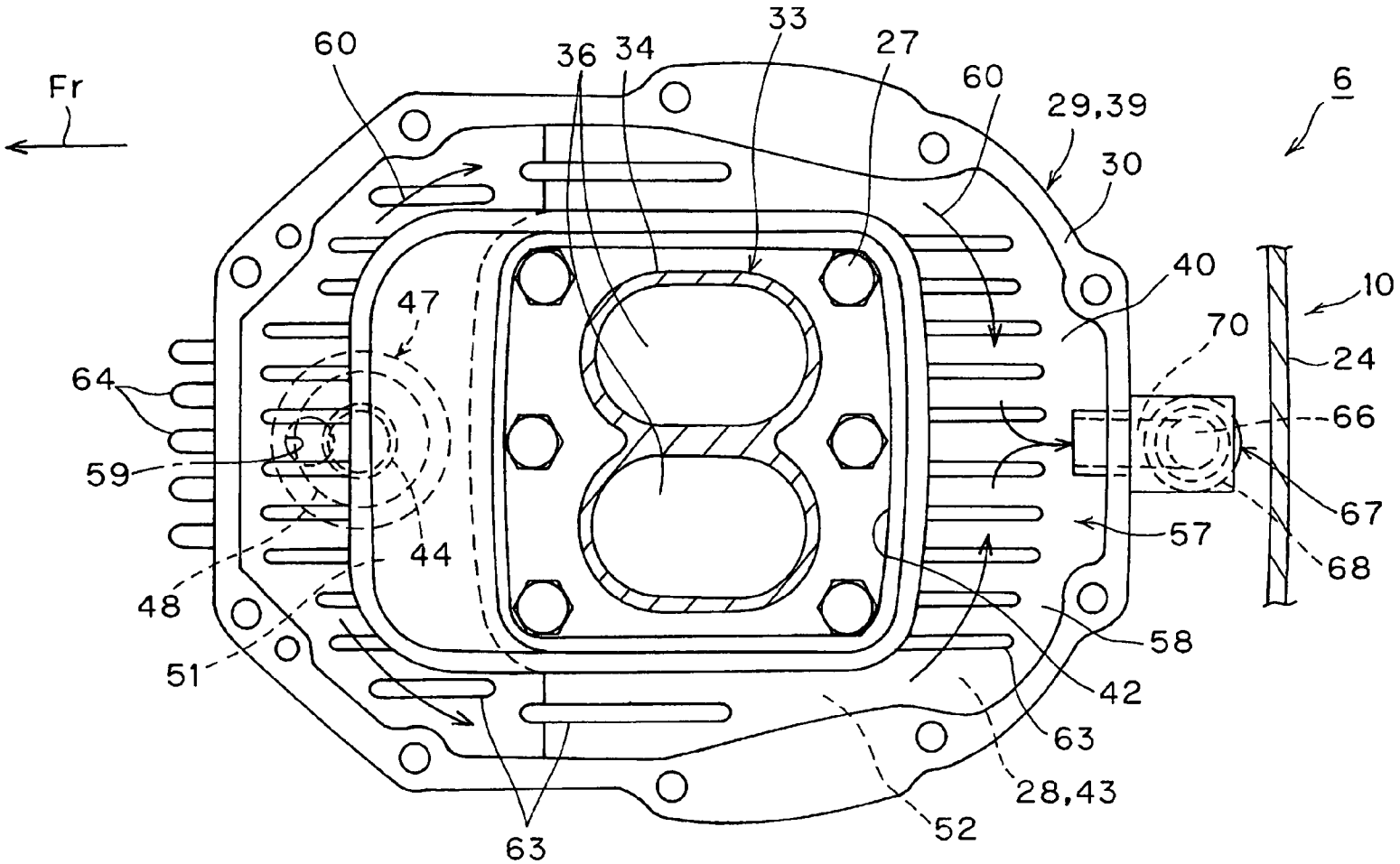
FIG. 4 is a partial sectional view, taken along the line 4-4 in FIG. 3. An oil conduit and associated oil pump are shown in phantom.

An oil holding chamber 43 for holding oil is defined between a pair of opposing inner surfaces 142, 140 of the oil pan body 40. In the illustrated embodiment, the inner wall 42 and an outer wall 150 of the oil pan body 40 form sidewalls defining oil holding chamber 43. A bottom 160 extends between the inner and outer walls 42, 150. The inner wall 42 has a somewhat rectangular shape as viewed from above, as illustrated in FIG. 4; however, the inner wall 42 can have other shapes, if needed or desired. In some embodiments, the wall 42 can have other shapes, including polygonal (including rounded polygonal), circular, elliptical, and the like.

The upper end surface of the inner wall 42 can form part of the upper end surface 26 of the oil pan 29. The upper end surface 26 of the oil pan 29 can mate with the lower surface of the exhaust guide 23. A plurality of fasteners 27 secures the upper end surface 26 of the oil pan 29 to the exhaust guide 23.

The upper end of the inner wall 42 can form the upstream side of the exhaust passage 36. In the illustrated embodiment, the upper end of the inner wall 42 defines a portion of the exhaust passage 36 extending between the exhaust guide 23 and the exhaust conduit 34. Exhaust gases 32 can flow through the exhaust guide 34, the upper end of the oil pan 29, and then through the exhaust conduit 34.

The exhaust conduit 34 is preferably spaced from the inner wall 42. The upper end portion of the exhaust conduit 34 and the upper end portion of the inner wall 42 are both coupled to the exhaust guide 23 with the fasteners 27. In the illustrated embodiment of FIG. 2, the upper end portion of the inner wall 42 is sandwiched between the exhaust guide 23 and the exhaust conduit 34.

The lubrication system 129 can include the oil conduit 47 extending generally in the vertical direction when the outboard motor 6 is vertically oriented, as illustrated in FIG. 1. The illustrated oil conduit 47 is generally parallel to the axis 18. A front portion of the oil pan 29 can receive the oil conduit 47. The front portion of the oil pan 29 can be positioned lower than the rear portion of the oil pan 29, such that oil collects in the front portion of the oil pan 29. In some embodiments, the front portion of the oil pan 29 can comprise a lower portion that supports lubricant 28.

The oil conduit 47 extends downwardly from the exhaust guide 23. In the illustrated embodiment, an oil passage 46 extends upwardly from the oil conduit 47 through the exhaust guide 23. The oil conduit 47 has a lower end 44 and an opposing upper end 45. The lower end 44 of the oil conduit 47 is positioned within the front portion of the oil pan 29. An upper end 45 of the oil conduit 47 is in communication with the oil passage 46 of the exhaust guide 23. As such, the lubricant 28 in the chamber 43 can flow through the oil conduit 47.

Figure 3:
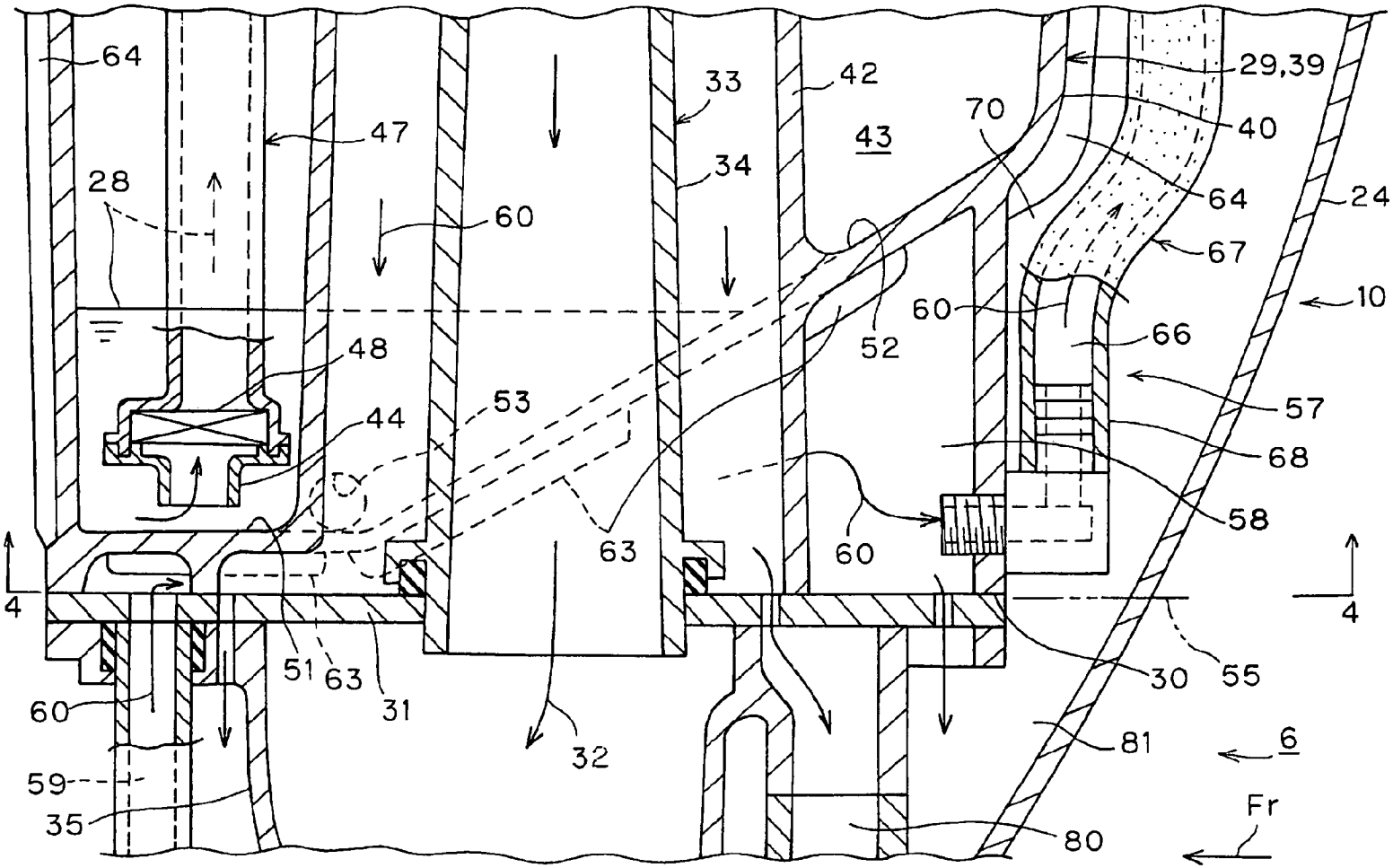
FIG. 3 is a partially enlarged, sectional view of the outboard motor of FIG. 1.

With reference to FIGS. 2 and 3, the lubrication system 129 can also filter oil if desired. The illustrated lubrication system 129 includes a strainer 48 at the lower end 44 of the oil conduit 47. The lower end 44 of the oil conduit 47 and the strainer 48 are preferably positioned between the surface 142 of the inner wall 42 and the surface 140 of the pan body 40. The strainer 48 can comprise one or more filters.

The oil pump 49 can be operated to feed the lubricant 28 held in the oil pan 29 to one or more components of the internal combustion engine 12. In some embodiments, including the illustrated embodiment, the oil pump 49 draws the lubricant 28 through the lower end 44 of the oil conduit 47. The oil flows upwardly through the oil conduit 47 and ultimately out of the upper end 45 into the oil passage 46. The lubricant 28 is then delivered to the internal combustion engine 12. Various types of oil pumps can be employed to deliver lubricant 28 to the engine 12. If desired, the oil pump 49 can be driven by the engine 12, thus eliminating the need for a separate oil pump motor.

The power transmission shaft 19 of the power transmission 14 can be disposed in front of the oil pan 29. If the oil pump has a rotor, the rotor can be located along the axis 18. In the illustrated embodiment, the crankshaft 13 and the power transmission shaft 19 rotate about the axis 18. Additionally, the rotor can be interconnected to the crankshaft 13 and the power transmission shaft 19.

The oil pump 49 can be positioned in the vicinity of the oil pan 29, as shown in FIG. 2. At least a portion of the oil pump 49 can be positioned forward of the oil pan 29. Additionally, at least a portion of the oil pump 49 can be positioned higher than the exhaust guide 23 and/or the oil pan 29. At least a portion of the oil pump 49 is vertically positioned between the internal combustion engine 12 and the exhaust guide 23. In some embodiments, a substantial portion of the oil pump 49 is vertically positioned between the internal combustion engine 12 and the exhaust guide 23.

With reference to FIGS. 2 and 3, the oil pan 29 defines a lower portion 51 located beneath the lower end 44 of the oil conduit 47. The lower portion 51 is preferably the deepest part of the oil pan 29. As such, the lubricant 28 can be collected within the lower portion 51 in order to ensure that oil is continuously fed to the oil conduit 47. The lower end 44 of the oil conduit 47 has an opening positioned above, but in the vicinity of, the lower portion 51. Even if a relatively small amount of oil is in the oil pan 29, the lower end 44 can remain submerged. The lower portion 51 can define a generally flat, horizontally extending surface 151. The surface 151 can form the lowest most inner surface of the pan 29. As shown in FIG. 3, the lower portion 51 extends laterally in front of the exhaust conduit 34. The rear end of the lower portion 51 can be positioned in front of the central part of the oil pan 29. In some embodiments, the rear end of the lower portion 51 can be in generally the same longitudinal position as the front end of the wall 42.

Other portions of the bottom 160 of the oil pan 29 can be positioned higher than the lower surface 151 of the portion 51. In the illustrated embodiment, the bottom surface 152 of an upper portion 52 of the oil pan 29 is positioned higher than the lower portion 51. The upper portion 52 can be positioned rearward of the lower portion 51. The upper portion 52 can be a generally flat surface 152 that slopes up rearward from the rear end of the surface 151. In such embodiments, the shape of the oil pan 29 is simpler than oil pans having a stepped shape and thus easier to manufacture.

With reference to FIG. 3, one or more drain holes can be provided for draining the lubricant 28. The illustrated lubrication system 29 includes a drain hole 53 for draining the lubricant 28 in the deepest portion of the oil pan 29 out of the case 10. In some embodiments, the drain hole 53 is disposed along the outer wall of the oil pan 29; however, the drain hole 53 can be positioned at other locations.

In some embodiments, including the illustrated of FIG. 1, an upper end wall surface 26 of the oil pan 29 can be located generally on an imaginary plane 54. The illustrated imaginary plane 54 extends horizontally and is generally orthogonal to the axis 18. Of course, when the outboard motor 6 is trimmed/tilted, the imaginary plane 54 may not be horizontally oriented.

The lower end surface 30 of the oil pan 29 can be located on another imaginary plane 55. The imaginary plane 55 can be generally parallel to the imaginary plane 54. The imaginary planes may or may not be horizontally oriented. As such, a substantial portion of the oil pan 29 can be interposed between the imaginary planes 54, 55. In some embodiments, the entire oil pan 29 is interposed between the imaginary planes 54, 55.

With respect to FIGS. 2 and 3, a cooling system 57 can cool the engine 12 and the lubricant 28. The cooling system 57 is a water cooling system and preferably includes a cooling water jacket 58 formed in the bottom portion of the oil pan 29. The cooling water jacket 58 is formed by a lower surface of the oil pan 29 and the upper surface of the partition plate 3. Water can flow through a passageway of the water jacket 58 to cool the lubricant 28. Because the oil pan 29 forms at least a portion of the cooling water jacket 58, the overall size of the oil pan 29 can be reduced. Advantageously, the lubricant 28 can be cooled through the oil pan 29 while maintaining the compactness of the oil pan 29.

The surface area of the angled bottom of the oil pan 29 may be increased as compared to an oil pan having a bottom that extends horizontally. Accordingly, heat transfer between the oil pan 29 and the cooling water jacket 58 is improved. As a result, it is possible to cool more effectively the lubricant 28 through the oil pan 29.

The water cooling system 57 can have a water pump 61 (FIG. 2) for drawing outside water 2 into the outboard motor 6. The water is then passed as cooling water 60 through the outboard motor 6. In the illustrated embodiment of FIG. 2, cooling water 60 flows to the pump 61 via a cooling water passage 59 formed in the case 10. A rotor of the water pump 61 can be located along the axis 18. In some embodiments, the rotor of the water pump 61 rotates about the axis 18, although the rotor of the pump 61 can be at other locations. The water pump 61 is preferably positioned in front of the oil pan 29. The engine 12 can drive the water pump 61. The water pump 61 can be positioned within the lower end of the upper case 24 below the oil pan 29.

The water cooling system 57 can also include one or more cooling elements for enhancing heat transfer. To enhance heat transfer between the cooling water 60 and the oil pan 29, a plurality of cooling elements 63 can be formed along the bottom surface of the oil pan 29. The cooling elements 63 can be fins, protrusions, or other structures for promoting efficient heat transfer. The illustrated cooling elements 63 are fins that are integrally formed with the bottom of the oil pan 29. These fins 63 can extend into the cooling water jacket 58 so that they are in direct contact with cooling water 60 flowing through the jacket 58. The illustrated cooling fins 63 of FIG. 4 extend along the general longitudinal direction of the hull 3 when the outboard motor 6 is general parallel with the longitudinal axis of the hull 3, as shown in FIG. 4. The fins 63 can be evenly or unevenly spaced along the oil pan 29 depending on the thermal requirements of the application.

Cooling elements can also be at other locations along the oil pan 29. With respect to FIGS. 3 and 4, cooling elements in the form of fins 64 can be positioned on the surfaces 140, 142 of the oil pan 29. The illustrated oil pan 29 has fins 64 on both its front and rear faces that directly contact the lubricant 28. These fins 64 can be integrally formed with the front and rear faces of the oil pan 29. These fins 63, 64 are vertically extending fins that can be evenly or unevenly spaced along the oil pan 29. For somewhat uniform temperature distributions, the fins 63, 64 are provided at generally uniform pitches in the lateral direction.

In addition, or the alternative, cooling elements can be positioned along the surface of the bottom 160 of oil pan 63. For example, cooling fins can extend from the inner surface of the oil pan 29. These fins can enhance heat transfer from the lubricant 28 through the oil pan 29 to cooling water 60. In some embodiments, cooling fins can be positioned on either side of the oil pan 29. The fins may or may not be integrally formed with the oil pan 29.

A cooling water conduit 67 provides fluid communication between the cooling water jacket 58 and the engine 12. The illustrated cooling water conduit 67 is positioned within the upper case 24 of the case 10. Non-limiting exemplary cooling water conduits can be flexible conduits made of polymers, rubbers, or other suitable materials for forming the engine conduits.

The conduit 67 defines a water passage 66 that extends between the water jacket 58 and the engine 12. The water passage 66 is preferably formed by an inner surface of the cooling water conduit 67. A lower end 68 of the water conduit 67 is coupled to the oil pan 29. In some embodiments, the lower end 68 is removably attached to the rear lower end of the oil pan 29 by means of a joint. As such, the water conduit 67 is connected to the rear lower end of the water jacket 58. The upper end 69 of the water conduit 67 is removeably coupled to the rear end of the outward directing flange 41, by means of a joint. The conduit 67 is thus securely mounted to the oil pan 29.

A space 70 can be formed between the conduit 67 and the oil pan 29. The space 70 can be formed along almost the entire longitudinal length of the conduit 67 and the oil pan 29. The space 70 can be formed between at least the upper part of the oil pan 29 and the conduit 67, so that the oil pan 29 and the conduit 67 are located apart from each other. The conduit 67 is preferably positioned behind the oil pan 29, although the conduit 67 can be at other locations.

Another cooling water conduit 72 can connect the upper end 69 of the conduit 67 to the internal combustion engine 12. The cooling water conduit 72 can define a passage 71. One end 73 of the conduit 72 is removably connected to the exhaust guide 23 by means of a joint. The other end 74 of the conduit 72 is removably connected to the exhaust guide 23 by means of a joint. Thus, both ends 73, 74 are coupled to the exhaust guide 23.

The conduit 72 provides fluid communication between the conduit 67 and the engine 12. A communication passage 76 can extend between the lower end 73 of the upper conduit 72 and the upper end 69 of the conduit 67. The communication passage 76 can be formed in both the exhaust guide 23 and the outwardly extending flange 41 of the oil pan 29. As such, cooling water can flow through the exhaust guide 23 and the outwardly extending flange 41 via the communication passage 76.

With reference to FIG. 2, the upper end 74 of the upper conduit 72 is connected to a cooling water jacket (not shown) formed in the internal combustion engine 12. One or more communication passages 77 can be formed in both the exhaust guide 23 and the internal combustion engine 12. Cooling water can flow from the conduit 72 through the communication passages 77.

One or more sealing members can be used to contain fluid. For example, one or more sealing members can be positioned between the exhaust guide 23 and the oil pan 29. In some embodiments, a gasket (e.g., metal gasket) is interposed between mating surfaces of the exhaust guide 23 and the oil pan 29. The gasket can have one or more arcuate raised, sealing beads. Preferably, a first bead surrounds the oil holding chamber 43 of the outboard motor 6 and a second bead surrounds the communication passage 76. The first and second beads create a double seal between the communication passage 76 and the oil holding chamber 43. Therefore, the cooling water 60 flowing through the communication passage 76 is inhibited from leaking out of the communication passage 76 and mixing with the lubricant 28. Other sealing means can be employed to avoid leaking between components of the motor 6.

The cooling water 60 can flow through communication passages 77 to cool the engine 12. For example, the cooling water 60 from the communication passages 77 can flow through a cooling water jacket to cool the internal combustion engine 12. The engine 12 can have various types of cooling systems that utilize the cooling water 60. Additionally, or in the alternative, the cooling water 60 can be used to cool other engine components, if needed or desired.

After the cooling water cools the engine 12, the water can flow out of the outboard motor 6. In some embodiments, heated water 2 from the engine 12 can flow downwardly through a water discharge passage 80. The water discharge passage 80 can extend through a space defined between the outside surface of the exhaust conduit 34 and the inside surface of the inner wall 42 of the oil pan 29. The passage 80 preferably extends downwardly through the partition plate 31 and between the outer surface of the muffler 35 and the inner surfaces of upper case 24 and the lower case 25. In some embodiments, the space between the inside surface of the upper case 24 and the outer surfaces of the oil pan 29 and the muffler 35 define a water discharge passage 81 for discharging the cooling water into the outside water 2. The outboard motor 6 can have any number of cooling water passages for delivering water out of the engine 12.

When the internal combustion engine 12 operates, the propulsion unit 101 rotates the propeller 11 via the power transmission 14 in order to propel the watercraft 1. The exhaust gases 32 from the internal combustion engine 12 flow downwardly through the exhaust passage 36. The exhaust gases 32 flow into and through the exhaust conduit 34. As shown in FIG. 4, the exhaust conduit 34 can define multiple exhaust flow passageways. For enhanced exhaust gas flow, the exhaust conduit 34 has a pair of exhaust flow passageways arranged side-by-side. After the exhaust gases 32 flow through the exhaust conduit 34, the gases 32 flow through the muffler 35 and through the downstream side exhaust passage 37. Other configurations can also be used to discharge exhaust gases from the engine 12.

To increase the holding capacity of the oil pan 29, the rear upward slope angle of the portion 52 of the inside bottom of the oil pan 29 can be decreased. The illustrated rear upward angle $\alpha$ of FIG. 3 is about 30 degrees; however, the rear upward slope angle $\alpha$ can be in the range of about 10 to 70 degrees. In some non-limiting embodiments, the angle $\alpha$ is in the range of about 20 to 40 degrees. If the watercraft 1 rapidly accelerates in the direction forward, the watercraft 1 may be angled upwardly as shown in phantom in FIG. 1. The maximum upward slope angle of the watercraft 1 is generally 25 to 35 degrees, although other angles are possible. In some non-limiting exemplary embodiments, the upward slope angle $\alpha$ of the portion 52 of the inside bottom surface of the oil pan 29 can be in the range of 20 to 40 degrees, preferably 25 to 35 degrees. As such, the oil pan 29 ensures that lubricant 28 is held in the deepest section of the oil pan 29 even during sudden accelerations. The angle $\alpha$ of the oil pan 29 can be chosen based on the accelerations likely to be experienced during operation.

The lower end 44 of the oil conduit 47 preferably remains submerged in the lubricant 28, even during sudden accelerations. Thus, the oil pump 49 can continuously draw lubricant 28 in the oil pan 29 through the oil conduit 47 and eventually to the internal combustion engine 12. In the illustrated embodiment, the oil pump 49 operates in association with the internal combustion engine 12. The lubricant 28 stored in the oil pan 29 is drawn through the lower end 44 of the oil conduit 47. The oil pump 49 draws the lubricant 28 through the oil conduit 47 and into the oil passage 46. The lubricant 28 then flows through the oil passage 46 and ultimately to the engine 12 for maintaining proper lubrication of moving engine parts. The lubricant 28 is then returned to the oil pan 29 through a return passage. In this manner, the lubricant 28 can circulate through the lubrication system 129 to maintain proper lubrication of the engine 12.

Although the lower portion 51 and the upper portion 52 of the oil pan 29 are located at different heights, the upper end surface 26 and the lower end surface 30 of the oil pan 29 can be located on the imaginary planes 54 and 55, respectively. Such positioning facilitates connection of the oil pan 29 to the exhaust conduit 34 and the muffler 35. Accordingly, fabrication of these parts and their assembly are facilitated. As described above, the upper end surface 26 of the oil pan 29 can be located on the imaginary plane 54 extending approximately horizontally. The lower end surfaces 30 of the oil pan 29 can be located on the other imaginary plane 55 that is parallel to the imaginary plane 54.

The internal combustion engine 12 also operates in association with the water pump 61. When the engine 12 operates, outside water 2 is drawn through the cooling water passage 59 into the water pump 61, as shown in FIG. 2. The water pump 61 delivers the water 60 to the cooling water jacket 58. The cooling water 60 absorbs heat as it passes through the cooling water jacket 58, thus cooling the exhaust gases and/or the lubricant 28. The lubricant 28 is thus cooled through the oil pan 29 such that the lubricant 28 is maintained below a target temperature. The target temperature can be selected to minimize deterioration of the lubricant 28 due to overheating. The water jacket 58 defines a single passageway below a portion of the oil pan 29. In alternative embodiments, the water jacket 58 includes a plurality of passageways.

After the cooling water 60 within the cooling jacket 58 absorbs heat from the lubricant 28, the heated water 60 can flow through the cooling water jacket of the internal combustion engine 12. To reach the engine 12, the water 60 flows through the cooling water passage 66 of the conduit 67, the communication passage 76, and the upper cooling water passage 71 of the upper tube 72. The cooling water 60 then flows through the engine cooling jacket. After the cooling water 60 cools the engine 12, the heated water 60 can be discharged through the water discharge passage 80 into the outside water 2. In this manner, water can be circulated for effectively cooling the lubricant 28 and/or the engine 12.

If cooling water 60 leaks out of the communication passage 76 between the exhaust guide 23 and the outward directed flange 41, it can be discharged through the water discharge passage 81. This limits the amount of water collected in the outboard motor 6. Accordingly, leaking water can escape from the communication passage 76 without adversely affecting engine performance. To reduce leaking, one or more sealing members can be positioned along the passageway 76.

The configuration of the oil pan 29 results in a compact overall outboard motor design. Advantageously, the oil level for a specified amount of oil held in the oil pan 29 can be relatively high, even if the outboard motor is tilted. That is, even if the oil pan 29 tilts relative to the oil surface, the lower end 44 of the oil conduit 47 can remain submerged so that oil can be delivered to the engine 12. If the oil pan 29 tilts as a result of a rear upward turn of the lower part of the outboard motor 6 or of an upward motion of the bow of the watercraft 1 during rapid accelerations, the lower end 44 of the oil conduit 47 can also remain submerged in the lubricant 28.

Because the lower end 44 of the oil conduit 47 remains submerged, the lubricant 28 can be drawn through the oil conduit 47 without drawing in substantial amounts of air. Such a lubrication system can continuously deliver lubricant 28 to the engine 12 without significant amounts of air, thus ensuring proper engine lubrication. In this manner, a desired amount of lubricant 28 can be fed to the internal combustion engine 12.

As described above, the lower portion 51 is located under the lower end 44 of the oil conduit 47. The upper portion 52 is positioned higher than the lower portion 51 of the oil pan 29. The opening of the lower end 44 of the oil conduit 47 is therefore positioned in the deepest side of the chamber 43 of the oil pan 29. The oil conduit 47 and the oil pump 49 can be located in the vicinity of the front part of the oil pan 29. Thus, the oil conduit 47 and the oil pump 49 can be vertically arranged for a compact configuration. If desired, the oil conduit 47 and the oil pump 49 can be placed close to each other in the longitudinal direction of the watercraft 1.

Because the upper end 45 of the conduit 47 is near the oil pump 46, a relatively short passageway provides fluid communication between the conduit 47 and the pump 49. The construction of the lubrication system 129 including the oil passage 46 can be simplified for improved reliability.

Further, the rear end of the lower portion 51 of the inside bottom of the oil pan 29 is located on the front side of the center of the oil pan 29 in the longitudinal direction of the watercraft 1, and approximately at the same position as the front end of the wall 42. Accordingly, the oil level of a specific amount of oil held in the oil pan 29 may be increased.

The lower end 44 of the oil conduit 47 can remain submerged in the lubricant 28 as discussed above. The wall 42 can serves as a baffle against free flow of the lubricant 28 and serves to keep the oil level at a predetermined desired height. Because the lower end 44 remains submerged in lubricant 28, accidental suction of air into the oil pump 49 is avoided or reduced.

The upper case 24 and the oil pan 29 can have a one-piece or multi-piece construction. The illustrated upper case 24 and oil pan 29 have a one-piece construction. Further, the lower portion 51 and the upper portion 52 of the bottom of the oil pan 29 may be formed in a stepped shape. For example, one or more steps can be formed along the bottom surface of the oil pan 29.

A skilled artisan will recognize the interchangeability of various features from different embodiments disclosed herein. Similarly, the various features and steps discussed above, as well as other known equivalents for each such feature or step, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. For example, the lubrication system 129 can be used with other types of marine drives (i.e., inboard motors, inboard/outboard motors, jet drives, etc.) and also certain land vehicles. Furthermore, the lubrication system can be used as a stationary engine (e.g., a generator) for some applications as will be apparent to those of ordinary skill in the art in light of the description herein. Accordingly, it is not intended that the invention be limited, except as by the appended claims.

What is claimed is:

1. An outboard motor comprising a vertically extending case configured to be supported on a hull of a watercraft, an upper end of the case supporting an internal combustion engine, an oil pan that holds lubricant for lubricating the internal combustion engine, an exhaust passage extending downwardly from the internal combustion engine and defining an axis, an oil conduit extending upwardly towards the internal combustion engine and having a lower end defining an opening, and an oil pump adapted to draw lubricant through the lower end of the oil conduit and direct a lubricant flow through the oil conduit and to the internal combustion engine, the oil pump being positioned in the vicinity of a front portion of the oil pan when the outboard motor is attached to the hull, the oil pan having a bottom comprising a first bottom surface and a second bottom surface, a lower portion of the oil pan being located below the lower end of the oil conduit and comprising the first bottom surface, the lower portion being positioned forwardly of the second bottom surface, and the second bottom surface is generally vertically higher than the first bottom surface and slopes downwardly in a forward direction to beyond the axis of the exhaust passage.

2. The outboard motor of claim 1, wherein an upper end surface of the oil pan is located on an imaginary plane extending substantially horizontally, and a lower end surface of the oil pan is located below the first and second bottom surfaces of the oil pan and is located on another imaginary plane extending substantially horizontally.

3. The outboard motor of claim 1, wherein a plurality of cooling fins are formed on a lower bottom surface of the oil pan.

4. The outboard motor of claim 3, wherein the lower bottom surface of the oil pan defines at least a portion of a cooling water jacket for cooling oil held in the oil pan, and the cooling fins extend at least partially through a passageway of the cooling water jacket.

5. The outboard motor of claim 3, wherein the plurality of cooling fins extends into a chamber of the oil pan.

6. The outboard motor of claim 1, wherein the oil pan forms at least a portion of a cooling jacket that cooling fluid flows through.

7. The outboard motor of claim 1, wherein the second bottom surface is sloped upwardly towards a rear of the outboard motor.

8. The outboard motor of claim 1, wherein the second bottom surface of the oil pan slopes upward rearwardly at an angle of elevation of about 20 to 40 degrees relative to a surface of the lower bottom portion.

9. The outboard motor of claim 1, wherein the second bottom surface slopes downwardly in a forward direction to beyond the exhaust passage.

10. An outboard motor comprising an internal combustion engine, an exhaust passage, and a lubrication system, the exhaust passage extending downwardly from the internal combustion engine and defining an axis, the lubrication system comprising a lubricant pan for holding lubricant that lubricates the internal combustion engine, the lubricant pan having a plurality of outwardly extending fins for dissipating heat from the lubricant pan, the lubricant pan having a bottom defining a lower bottom portion and an upper bottom portion being positioned higher than the lower bottom portion such that lubricant collects in the lower bottom portion when the outboard motor is in a substantially vertical orientation, the upper bottom portion sloping downwardly in a forward direction to beyond the axis of the exhaust passage, at least a portion of the lower bottom portion being positioned forward of the upper bottom portion, a lubricant conduit having a lower end and an upper end, the lower end defining a lower opening and being positioned above the lower bottom portion of the lubricant pan, and a lubricant pump that draws lubricant supported by the lower bottom portion of the lubricant pan into the lower end of the lubricant conduit such that lubricant flows through the lubricant conduit towards the internal combustion engine.

11. The outboard motor of claim 10, wherein at least a portion of the lubricant pump is positioned in front of the lubricant pan.

12. The outboard motor of claim 11, wherein the bottom has a sloped inside surface such that lubricant flows to the lower bottom portion when the amount of lubricant in the lubricant tank is less than a predetermined amount.

13. The outboard motor of claim 10, wherein the lubricant pan comprises upper mounting surfaces and lower mounting surfaces that lie substantially along two imaginary planes, and the imaginary planes are substantially parallel to one another.

14. The outboard motor of claim 10, wherein an outer bottom surface of the lubricant pan defines at least a portion of a cooling water channel of a cooling water jacket.

15. The outboard motor of claim 10, wherein the plurality of fins define at least a portion of a water cooling jacket passage that surrounds at least a portion of the lubricant pan.

16. The outboard motor of claim 10, wherein at least a portion of the lubricant pump is positioned above the lubricant pan.

17. The outboard motor of claim 10, wherein a surface of the upper bottom portion of the lubricant pan slopes upward rearwardly at an angle of elevation of about 20 to 50 degrees relative to a surface of the lower bottom portion.

18. The outboard motor of claim 10, wherein the upper bottom portion slopes downwardly in a forward direction to beyond the exhaust passage.

19. An outboard motor comprising a vertically extending case configured to be supported on a hull of a watercraft, an upper end of the case supporting an internal combustion engine, an exhaust passage extending downwardly from the internal combustion engine and defining an axis, an oil pan that holds lubricant for lubricating the internal combustion engine, an oil conduit extending upwardly towards the internal combustion engine and having a lower end defining an opening, and an oil pump adapted to draw lubricant through the lower end of the oil conduit and direct a lubricant flow though the oil conduit and to the internal combustion engine, the oil pump being positioned in the vicinity of a front portion of the oil pan when the outboard motor is attached to the hull, the oil pan having a bottom comprising a first bottom surface and a second bottom surface, a lower portion of the oil pan being located below the lower end of the oil conduit and comprising the first bottom surface, the lower portion being positioned forwardly of the second bottom surface, the second bottom surface being generally vertically higher than the first bottom surface and sloping downwardly in a forward direction to beyond the axis of the exhaust passage, the motor further comprising an outer lower bottom surface of the oil pan that defines at least a portion of a cooling water jacket for cooling oil held in the oil pan.

20. The outboard motor of claim 19, further comprising a plurality of cooling fins.

21. The outboard motor of claim 20 wherein the cooling fins are formed on the lower bottom surface of the oil pan.

22. The outboard motor of claim 20, wherein the cooling fins extend at least partially through a passageway of the cooling water jacket.

23. The outboard motor of claim 19, wherein the second bottom surface slopes downwardly in a forward direction to beyond the exhaust passage.

* * * * *

UNITED STATES PATENT AND TRADEMARK OFFICE

CERTIFICATE OF CORRECTION

PATENT NO. : 7,350,497 B2
APPLICATION NO. : 11/283557
DATED : April 1, 2008
INVENTOR(S) : Hiraoka It is certified that error appears in the above-identified patent and that said Letters Patent is hereby corrected as shown below:

At Column 14, line 23, in Claim 19, please delete “though” and insert

-- through --, therefore.

Signed and Sealed this

Tenth Day of February, 2009

JOHN DOLL
*Acting Director of the United States Patent and Trademark Office*